US008082597B2

(12) United States Patent
Young

(10) Patent No.: US 8,082,597 B2
(45) Date of Patent: Dec. 27, 2011

(54) CONVERTIBLE SHIRT

(76) Inventor: Anita R. Young, Ranger, GA (US)

( * ) Notice: Subject to any disclaimer, the term of this patent is extended or adjusted under 35 U.S.C. 154(b) by 62 days.

(21) Appl. No.: 12/505,247

(22) Filed: Jul. 17, 2009

(65) Prior Publication Data

US 2011/0010821 A1 Jan. 20, 2011

(51) Int. Cl.
*A41B 1/22* (2006.01)

(52) U.S. Cl. ..... 2/119; 2/95; 2/102

(58) Field of Classification Search ..... 2/91, 59, 2/90, 96, 51, 97, 158, 95, 102, 119, 101, 2/108

See application file for complete search history.

(56) References Cited

U.S. PATENT DOCUMENTS 1,157,341 A * 10/1915 Tallerday ..... 2/91
1,250,836 A * 12/1917 Fowler ..... 2/91
1,285,917 A * 11/1918 Smith ..... 2/91
1,830,726 A * 11/1931 Wetzler ..... 2/102
4,554,682 A * 11/1985 Hillquist ..... 2/70
4,567,611 A * 2/1986 Kendrick ..... 2/104
4,570,267 A * 2/1986 Appel ..... 2/91
4,706,304 A * 11/1987 Jones ..... 2/91
5,157,792 A * 10/1992 Allen et al. ..... 2/2.5
6,029,270 A * 2/2000 Ost et al. ..... 2/2.5
6,330,720 B1 * 12/2001 Steelman ..... 2/93
7,028,342 B1 * 4/2006 Nordstrom et al. ..... 2/119
7,343,629 B2 3/2008 Hunt
7,818,817 B1 * 10/2010 Owens et al. ..... 2/54

* cited by examiner

*Primary Examiner* — Katherine Moran
*Assistant Examiner* — Richale Quinn
(74) *Attorney, Agent, or Firm* — Crose Law LLC; Bradley D. Crose

(57) ABSTRACT

A convertible shirt having a sleeveless base and a sleeved half-shirt configured to couple to the sleeveless base is disclosed. In at least one embodiment, a convertible shirt includes a sleeveless base, a sleeved half shirt configured to couple inconspicuously to the sleeveless base, and a multiplicity of fasteners to couple to the sleeved half shirt to the sleeveless base. In at least one alternative embodiment a two-piece convertible Western shirt includes a sleeveless base, the sleeveless base having a flared, pointed collar, a button-up front, and at least a pair of pockets on a front side of the sleeveless base, a sleeved half shirt configured to couple inconspicuously to the sleeveless base, the sleeved half shirt having a Western adornment, and a multiplicity of fasteners configured to couple to the sleeved half shirt to the sleeveless base.

14 Claims, 4 Drawing Sheets

CONVERTIBLE SHIRT

FIELD OF THE INVENTION

The technology described herein relates generally to the fields of apparel, upper body garments, and Western apparel. More specifically, this disclosed technology relates to a convertible, two-piece shirt having a sleeveless base and a sleeved half-shirt configured to couple to the sleeveless base.

BACKGROUND OF THE INVENTION

Garments are well known in the apparel industry to include various layers, liners, interchangeabilities, and detachable portions. None, however, are known to do so in the same manner and with the same elements as does the convertible shirt disclosed herein. Known garments include layered jackets and running apparel. Additionally, known garments have shortcomings and deficiencies addressed by the technology described herein.

Related patents known in the background art include the following: U.S. Pat. No. 4,554,682, issued to Hillquist on Nov. 26, 1985, discloses a convertible jacket. U.S. Pat. No. 7,028,342 issued to Nordstrom et al. on Apr. 18, 2006, discloses a garment having multiple layers. U.S. Pat. No. 7,343,629, issued to Hunt on Mar. 18, 2008, discloses a riding jacket.

The foregoing patent and other information reflect the state of the art of which the inventor is aware and are tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides a convertible, two-piece shirt having a sleeveless base and a sleeved half-shirt configured to couple to the sleeveless base.

In one exemplary embodiment, the technology described herein provides a convertible shirt. The convertible shirt includes a sleeveless base, a sleeved half shirt configured to couple inconspicuously to the sleeveless base, and a multiplicity of fasteners to couple to the sleeved half shirt to the sleeveless base. In at least one embodiment, the convertible shirt is a two-piece Western shirt configured for use by riders of horses in barrel racing, and the like.

The sleeved half shirt can further include an arm length left sleeve and an arm length right sleeve. The arm length left sleeve and the arm length right sleeve each can further include a cuff.

The arm length left sleeve and the arm length right sleeve are yoked one to another by a half back panel to drape over a back panel of the sleeveless base and a pair of half front panels configured to drape over a front of the sleeveless base.

The sleeveless base can further include a multiplicity of buttons and a multiplicity of button holes on a front of the sleeveless base with which to join a left front panel and a right front panel of the sleeveless base.

The sleeveless base can alternatively include a multiplicity of snaps on a front of the sleeveless base with which to join a left front panel and a right front panel of the sleeveless base.

The sleeveless base can further include a collar. The collar can be flared, pointed, and Western in aesthetic appearance. The sleeveless base can further include a pair of pockets. Each of the pair of pockets can further include one of the multiplicity of fasteners. The multiplicity of fasteners can include buttons and button holes, snaps, and hook and eye fasteners.

The convertible shirt can further include one or more adornments such as fringe, lace, ribbing, and the like, to provide adornment to the sleeved half shirt on a half back panel to drape over a back panel of the sleeveless base and on a pair of front panels configured to drape over a front of the sleeveless base.

The sleeved half shirt and the sleeveless base can each be configured to be interchangeable with a sleeved half shirt and a sleeveless base of another convertible shirt of like fasteners for coupling.

The sleeved half shirt and the sleeveless base can each be configured to be operatively worn individually and operatively coupled one to another as a single shirt, as selected by the wearer.

In another exemplary embodiment, the technology described herein provides a two-piece convertible Western shirt. The two-piece convertible Western shirt includes a sleeveless base, the sleeveless base having a flared, pointed collar, a button-up front, and at least a pair of pockets on a front side of the sleeveless base, a sleeved half shirt configured to couple inconspicuously to the sleeveless base, the sleeved half shirt having at least one Western adornment selected from the group consisting of: fringe, lace, and ribbing, and a multiplicity of fasteners configured to couple to the sleeved half shirt to the sleeveless base.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides a convertible, two-piece shirt having a sleeveless base and a sleeved half-shirt configured to couple to the sleeveless base. The convertible, two-piece shirt provides a garment that can be worn with less covering of the wearer (i.e., sleeveless) and thus keep the wearer cooler. Worn in this manner, the wearer can, for example, work or prepare for a race, without soiling the sleeved half-shirt. The convertible, two-piece shirt also provides a garment that can be worn in a more formal setting with the sleeved half-shirt applied over the sleeveless base. Wearing the convertible, two-piece shirt in this manner adds warmth and formality without requiring the wearer to have to change clothing and remove the sleeveless base.

Referring now to the Figures a two-piece, convertible shirt 10 is shown. The convertible shirt 10 includes a sleeveless base 28 and a sleeved half shirt 12 configured to couple inconspicuously to the sleeveless base 28.

Figure 1:
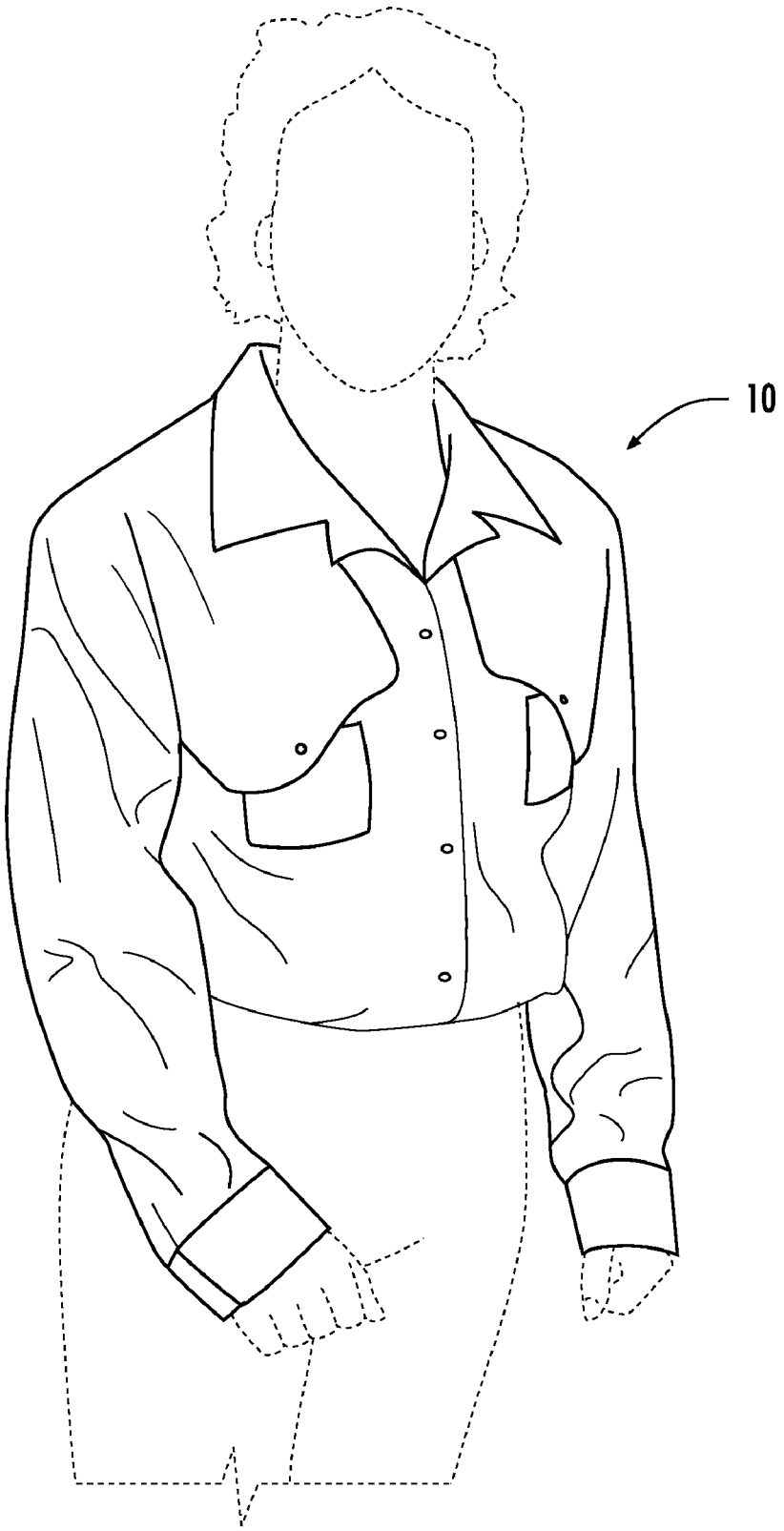
FIG. 1 is a front perspective view of a convertible, two-piece shirt, according to an embodiment of the technology.
Figure 2:
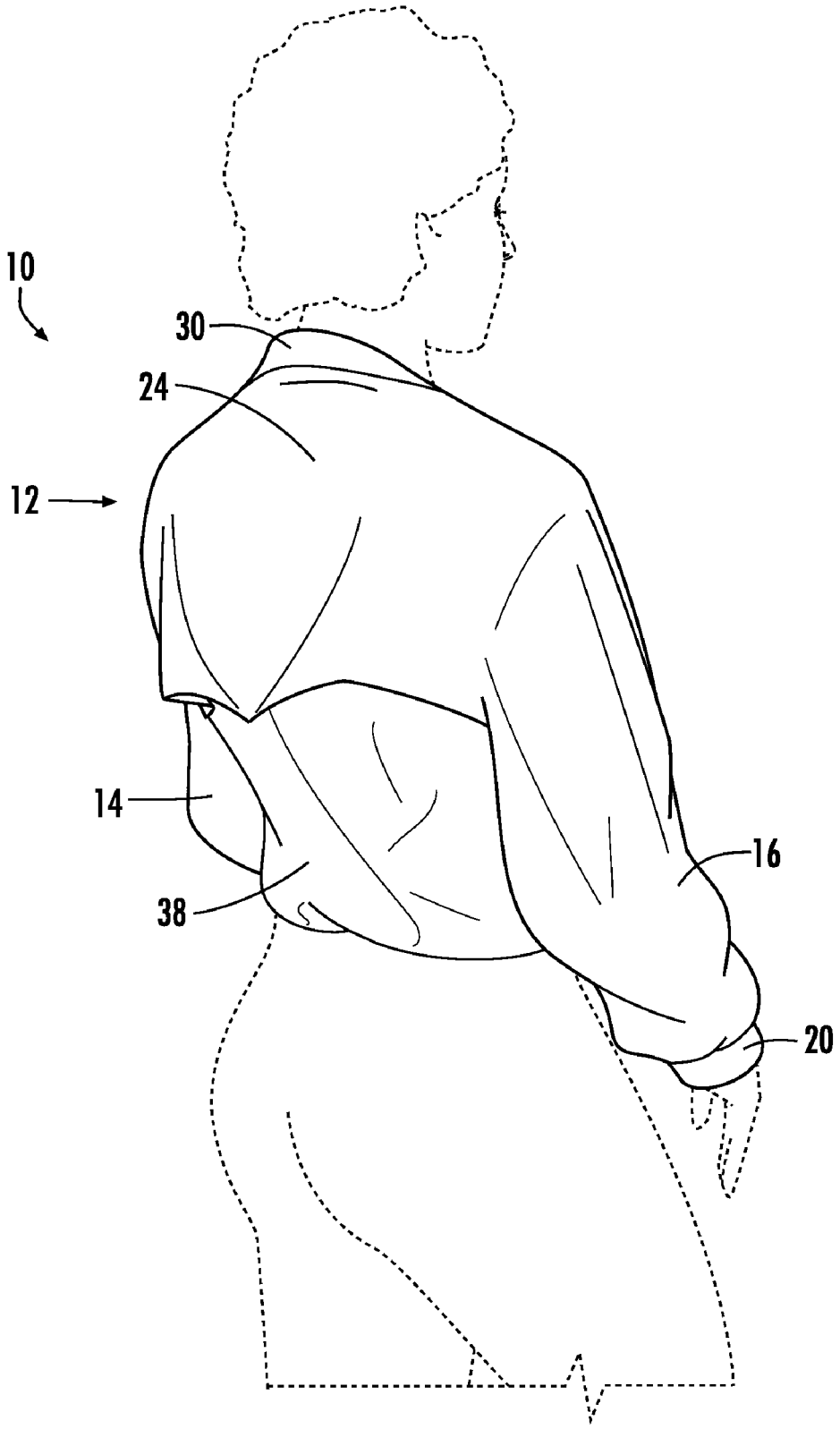
FIG. 2 is a rear perspective view of the convertible, two-piece shirt depicted in FIG. 1.
Figure 3:
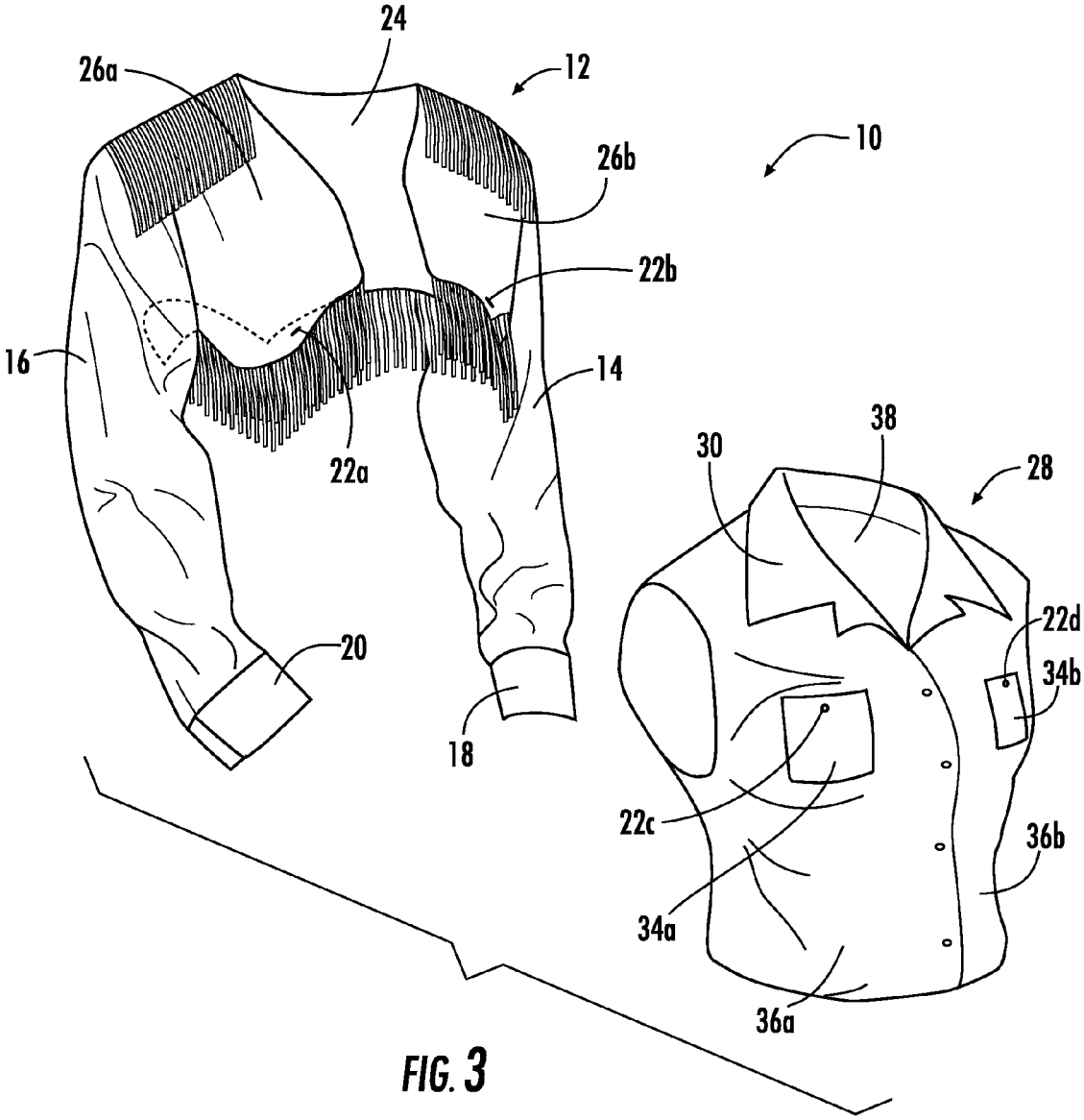
FIG. 3 is an expanded view of the convertible, two-piece shirt depicted in FIG. 1, illustrating, in particular, a sleeveless base and a sleeved half-shirt configured to couple to the sleeveless base, according to an embodiment of the technology.
Figure 4A:
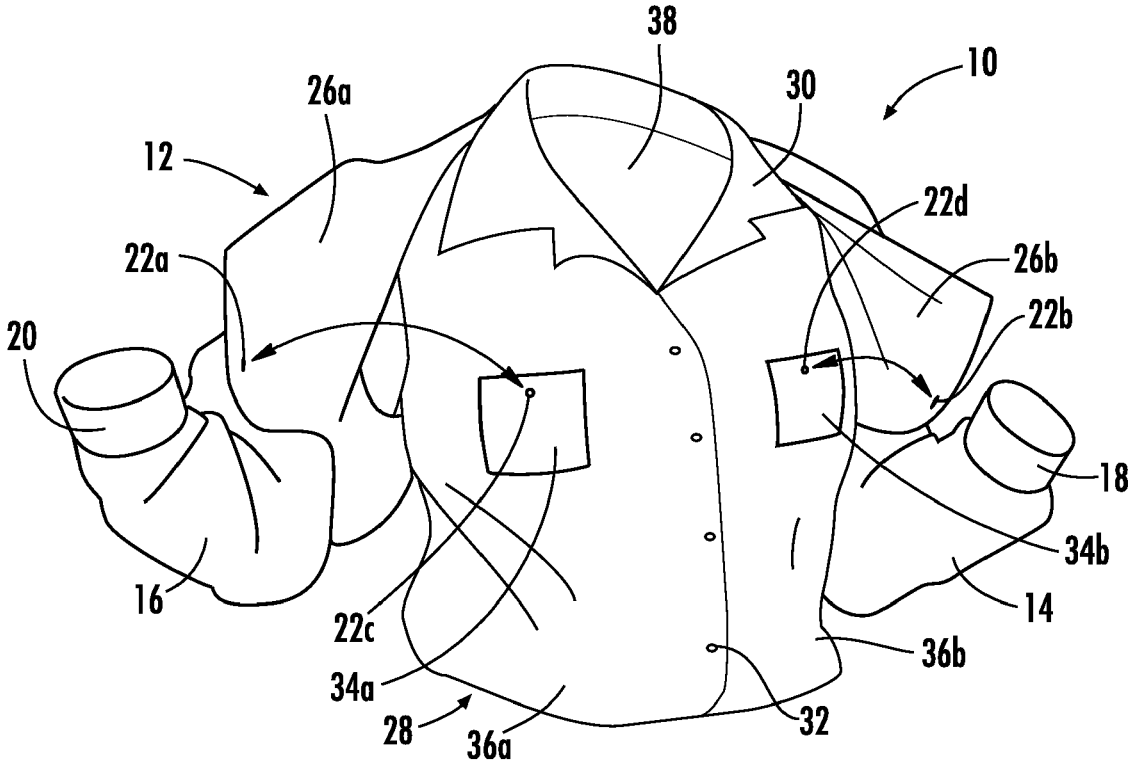
FIG. 4A is a front perspective view of a convertible, two-piece shirt depicted in FIG. 1, illustrating, in particular, an attachments means to attach the sleeved half-shirt to the sleeveless base, according to an embodiment of the technology.
Figure 4B:
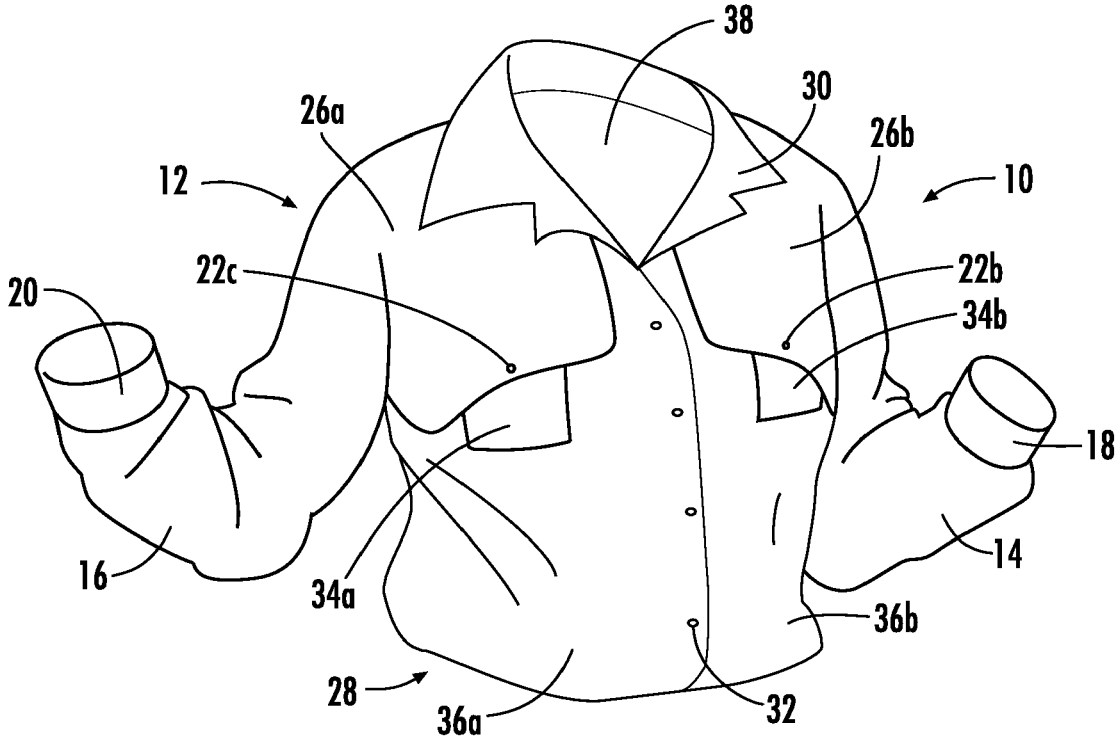
FIG. 4B is a front perspective view of a convertible, two-piece shirt depicted in FIG. 1, illustrating, in particular, an attachments means to attach the sleeved half-shirt to the sleeveless base, according to an embodiment of the technology.

As depicted specifically in FIG. 1, the two-piece, convertible shirt 10 is shown from a front perspective view, illustrating the sleeved half shirt 12 coupled to and worn upon the sleeveless base 28. As depicted specifically in FIG. 2, the two-piece, convertible shirt 10 is shown from a rear perspective view, illustrating the sleeved half shirt 12 coupled to and worn upon the sleeveless base 28. In use the sleeveless base 28 can be worn without the sleeved half shirt 12 in order to keep the wearer cooler and to allow for the sleeved half shirt 12 to remain ready to wear for a race or other formal event in which all components of the two-piece, convertible shirt 10 are worn together.

The sleeved half shirt 12 is coupled to the sleeveless base 28 with fasteners 22. As shown in the Figures, fasteners 22*a*, 22*b*, 22*c*, 22*d* are utilized. As will be apparent to one of ordinary skill in the art, the number, the type, and the placement locations of the fasteners can vary as long as the sleeved half shirt 12 is coupled quickly and easily to the sleeveless base 28 and the fasteners 22*a*, 22*b*, 22*c*, 22*d* securely hold the sleeved half shirt 12 to the sleeveless base 28 while coupled one to another and in use as a two-piece shirt.

By way of example, in at least one embodiment, fasteners 22*c*, 22*d* located on the sleeveless base 28 are buttons to be received in button holes 22*a*, 22*b* on the sleeved half shirt 12. Any one or more of the fasteners 22*a*, 22*b*, 22*c*, 22*d* can be located on a pocket 34*a*, 34*b* of the sleeveless base 28.

Also, by way of example, in at least one embodiment, fasteners 22*a*, 22*b* located on the sleeveless base 28 are snaps to be received in snap fittings 22*c*, 22*d* on the sleeved half shirt 12. Any one or more of the fasteners 22*a*, 22*b*, 22*c*, 22*d* can be located on a pocket 34*a*, 34*b* of the sleeveless base 28.

The sleeveless base 28 can further include a multiplicity of buttons and a multiplicity of button holes at locations 32 to secure a left front panel 36*b* and a right front panel 36*a* of the sleeveless base 28, as a traditional button-up shirt. The sleeveless base can alternatively include a multiplicity of snaps at location 32 on a front of the sleeveless base 28 with which to join a left front panel 36*b* and a right front panel 36*a* of the sleeveless base 28. As will be apparent to one of ordinary skill in the art, the use of buttons, snaps, and the like can be varied if style, shape, size, and application. By way of example, in one embodiment in which the two-piece, convertible shirt 10 is a Western shirt, the buttons, or the like, can be Western in style and function.

The sleeveless base 28 can further include a collar 30. The collar 30 can cover a portion of the neck area of the wearer. In at least one embodiment, the convertible shirt 10 is a two-piece Western shirt configured for use by riders of horses in barrel racing, and the like, and the collar 30 is a Western collar. By way of example, the collar 30 is pointed and flared and contains a Western pattern.

The sleeveless base 28 can further include on or more pocket. As shown, the sleeveless base includes a pair of pockets 34*a*, 34*b*. Each of the pair of pockets 34*a*, 34*b* can further include one of the multiplicity of fasteners, such as 22*c*, 22*d*, for example. In at least one embodiment, the convertible shirt 10 is a two-piece Western shirt configured for use by riders of horses in barrel racing, and the like, and the pockets 34*a*, 34*b* are Western in fit and aesthetics. As will be apparent to one of ordinary skill in the art, the number, depth, width, and location of pockets 34*a*, 34*b* on the convertible shirt 10 can vary.

The sleeved half shirt 12 can further include an arm length left sleeve 14 and an arm length right sleeve 16 as shown. The arm length left sleeve 14 and the arm length right sleeve 16 can further include a left cuff 18 and right cuff 20, respectively. As will be apparent to one of ordinary skill in the art, the specific length of the sleeves 14, 16, and whether the sleeves 14, 16 includes cuffs 18, 20 can vary. In embodiments wherein the convertible shirt is a Western-style shirt, the sleeves 14, 16 are arm length and include cuffs 18, 20.

The arm length left sleeve 14 and the arm length right sleeve 16 are yoked one to another by a half back panel 24 to drape over a back panel 38 of the sleeveless base 28 and a pair of front panels 26*a*, 26*b* configured to drape over the upper portions of a front 36*a*, 36*b* of the sleeveless base 28. As will be apparent to one of ordinary skill in the art, the amount by which the sleeved half-shirt 12 drapes over portions of the sleeveless back 28 can vary in length and style, such as with adornments.

In various embodiments, the arm length left sleeve 14 and the arm length right sleeve 16 can be made from varied fabrics, materials, colors, and the like, and can differ from that of the half back panel 24 and pair of front panels 26*a*, 26*b*. In embodiments wherein the convertible shirt is a Western-style shirt, the sleeves 14, 16, the half back panel 24, and the pair of front panels 26*a*, 26*b* are chosen with a Western theme and can include fringe, for example.

The convertible shirt 10 can further include an adornment such as fringe, lace, ribbing, and the like to provide adornment to the sleeved half shirt 12 on a half back panel 24 to drape over a back panel 38 of the sleeveless base 28 and on a pair of front panels 26*a*, 26*b* configured to drape over a front of the sleeveless base 28. As will be apparent to one of ordinary skill in the art, the adornments can vary in style, color, placement location, and the like, as desired for the ultimate purpose of the shirt.

The sleeved half shirt 12 and the sleeveless base 28 can each be configured to be interchangeable with a sleeved half shirt 12 and a sleeveless base 28 of another convertible shirt 10 of like fasteners 22*a*, 22*b*, 22*c*, 22*d* for coupling. Thus, the sleeved half shirt 12 and the sleeveless base 28 are easily interchangeable.

The sleeved half shirt 12 and the sleeveless base 28 can each be configured to be operatively worn individually and operatively coupled one to another as a single shirt 10, as selected by the wearer. Thus, the sleeved half shirt 12 and the sleeveless base 28 are flexible in choice of use.

The convertible shirt 10 is useful, for example, in riding competitions, such as barrel racing, and the like, wherein a rider has a particular garment to be worn for the competition or show. The convertible shirt 10 enables a rider to protect the outermost portions of the convertible shirt 10 while not having to changes shirts. By way of example, a rider can wear the sleeveless base 28 while preparing the horse, and the like, prior to a race and subsequently couple the sleeved half shirt 12 to the sleeveless base 28 just prior to riding. This provides the rider with the option of protecting the sleeved half shirt 12 from being soiled, while at the same time allowing the rider to not be required to change shirts.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

What is claimed is:

1. A convertible shirt comprising:

a sleeveless base, wherein the sleeveless base is configured for wear as a sleeveless shirt;

a collar disposed upon the sleeveless base shirt;

a pair of breast pockets disposed upon the sleeveless base;

an interchangeable sleeved half shirt configured to couple inconspicuously to the sleeveless base, wherein the combined sleeved half shirt and sleeveless base are configured for combined wear as a sleeved shirt;

a first plurality of fasteners disposed on said breast pockets to couple the sleeved half shirt to the sleeveless base on the breast pockets; and a second plurality of fasteners disposed upon a front of the sleeveless base and configured to join a left front panel and a right front panel of the sleeveless base one to another;

at least one adornment selected from the group consisting of: fringe, lace, and ribbing is disposed on the sleeved half shirt on a half back panel and on a pair of front panels, such that the adornment is configured to drape over the front and back panels of the sleeveless base;

wherein the sleeveless base and the sleeved half shirt are each configured to be operatively worn individually and operatively coupled one to another as a single shirt; and wherein the sleeved half shirt and the sleeveless base are each configured to be interchangeable with a sleeved half shirt and a sleeveless base of another convertible shirt of like fasteners for coupling.

2. The convertible shirt of claim 1, wherein the sleeved half shirt further comprises an arm length left sleeve and an arm length right sleeve.

3. The convertible shirt of claim 2, wherein the arm length left sleeve and the arm length right sleeve each further comprises a cuff.

4. The convertible shirt of claim 2, wherein the arm length left sleeve and the arm length right sleeve are yoked one to another by a half back panel to drape over a back panel of the sleeveless base and a pair of front panels configured to drape over a front of the sleeveless base.

5. The convertible shirt of claim 1, wherein the sleeveless base further comprises a plurality of buttons and a plurality of button holes on a front of the sleeveless base with which to join a left front panel and a right front panel of the sleeveless base.

6. The convertible shirt of claim 1, wherein the sleeveless base further comprises a plurality of snaps on a front of the sleeveless base with which to join a left front panel and a right front panel of the sleeveless base.

7. The convertible shirt of claim 1, wherein the first plurality of fasteners comprises buttons and button holes.

8. The convertible shirt of claim 1, wherein the first plurality of fasteners comprises snaps.

9. The convertible shirt of claim 1, wherein the first plurality of fasteners comprises a plurality of hooks and a plurality of eyes configured to connect one to another.

10. A two-piece convertible Western shirt comprising:

a sleeveless base, wherein the sleeveless base is configured for wear as a sleeveless shirt, the sleeveless base having a flared, pointed collar, a button-up front, and at least a pair of breast pockets on a front side of the sleeveless base;

an interchangeable sleeved half shirt configured to couple inconspicuously to the sleeveless base, wherein the combined sleeved half shirt and sleeveless base are configured for combined wear as a sleeved shirt, the sleeved half shirt having at least one Western adornment selected from the group consisting of: fringe, lace, and ribbing; and a first plurality of fasteners disposed on said breast pockets configured to couple to the sleeved half shirt to the sleeveless base on the breast pockets;

a second plurality of fasteners disposed upon a front of the sleeveless base and configured to join a left front panel and a right front panel of the sleeveless base one to another; and at least one adornment selected from the group consisting of: fringe, lace, and ribbing is disposed on the sleeved half shirt on a half back panel and on a pair of front panels, such that the adornment is configured to drape over the front and back panels of the sleeveless base;

wherein the sleeveless base and the sleeved half shirt are each configured to be operatively worn individually and coupled one to another as a single shirt; and wherein the sleeved half shirt and the sleeveless base are each configured to be interchangeable with a sleeved half shirt and a sleeveless base of another convertible shirt of like fasteners for coupling.

11. The two-piece convertible Western shirt of claim 10, wherein the sleeved half shirt further comprises an arm length left sleeve and an arm length right sleeve, each sleeve further comprising a cuff.

12. The two-piece convertible Western shirt of claim 11, wherein the arm length left sleeve and the arm length right sleeve are yoked one to another by a half back panel to drape over a back panel of the sleeveless base and a pair of front panels configured to drape over a front of the sleeveless base, and wherein the half back panel and the pair of front panels further comprise at least one Western adornment selected from the group consisting of: fringe, lace, and ribbing.

13. The two-piece convertible Western shirt of claim 10, wherein the sleeveless base further comprises a plurality of buttons and a plurality of button holes on a front of the sleeveless base with which to join a left front panel and a right front panel of the sleeveless base.

14. The two-piece convertible Western shirt of claim 10, wherein the sleeveless base further comprises a plurality of snaps on a front of the sleeveless base with which to join a left front panel and a right front panel of the sleeveless base.

* * * * *